United States Patent [19]

Molina

[11] Patent Number: 4,619,321

[45] Date of Patent: Oct. 28, 1986

[54] METHOD AND APPARATUS FOR TREATING DOWN HOLE EQUIPMENT FROM CORROSION IN PRODUCTION WELL

[75] Inventor: John M. Molina, Odessa, Tex.

[73] Assignee: Jose F. Molina, Odessa, Tex. ; a part interest

[21] Appl. No.: 505,483

[22] Filed: Jun. 17, 1983

[51] Int. Cl.[4] ..... E21B 19/00

[52] U.S. Cl. ..... 166/90; 166/902

[58] Field of Search ..... 166/75 R, 90, 96, 244 C, 166/381

[56] References Cited

U.S. PATENT DOCUMENTS

| | | | |
|---|---|---|---|
| 2,713,908 | 7/1955 | Curtis | 166/244 C |
| 2,717,038 | 9/1955 | Curtis | 166/244 C |
| 4,279,300 | 7/1981 | Wirsch | 166/90 |

*Primary Examiner*—Stephen J. Novosad
*Assistant Examiner*—William P. Neuder
*Attorney, Agent, or Firm*—Harvey B. Jacobson

[57] ABSTRACT

A mount is provided for mounting from the above surface end of a well casing or tubing string and the mount defines a vertical passage therethrough. A plurality of mounting sleeves are supported from the mount at points spaced circumferentially about the passage and the sleeves open generally radially into the passage from the outer periphery thereof. A plurality of spray heads are removably supported within the sleeves for directing spray sets of liquid outwardly from the inner ends of the sleeves and the spray jets are communicated with the interior of a manifold construction disposed exteriorly of the mount. The manifold construction includes inlet structure whereby corrosion inhibiting liquid chemicals may be supplied thereto under pressure for discharge from the spray heads. The mount is removably mounted from the above surface end of a well casing or tubing string immediately prior to run in of tubing string sections or rods, a pump and other subsurface equipment whereby the exterior surfaces of such sub-surface equipment may be coated with a corrosion-inhibiting chemical as it is run in an associated well.

3 Claims, 4 Drawing Figures

METHOD AND APPARATUS FOR TREATING DOWN HOLE EQUIPMENT FROM CORROSION IN PRODUCTION WELL

BACKGROUND OF THE INVENTION

Most domestic petroleum reservoirs presently being discovered are not as prolific as earlier discoveries. Initially the reservoir energy may be sufficient to allow crude oil, gas and water to flow naturally to the surface. However, once the reservoir energy is depleted by production or, as in many cases, the original reservoir energy is not sufficient for natural flow, the oil well becomes non-productive by natural means. In order to recover additional crude oil reserves, artificial means of producing the well are used.

The most widely used method of artificial lift is the rod pump method. Artificial lift means are subject to failures which may be classified as either mechanical or corrosional. Regardless of the type of failure, the well has to be repaired to minimize down time and consequently lost oil production. Corrosion is probably the major cause of artificial lift failure. If corrosion can be at least minimally controlled, the savings realized by oil producers is considerable.

In the past, attempts have been made to combat corrosion by chemically treating the sub-surface equipment as it stands in the well bore. Two methods of treatment are continuous treatment and circulation treatment. In the first method a chemical injection pump is used to continually inject corrosion chemical into the tubing-casing annulus. The corrosion chemical is designed to adhere to the equipment surface, thus providing a protective barrier against corrosion. Basically, this type of treatment introduces corrosion chemical to every barrel of fluid that is produced. In the second method, the chemical is also introduced down the tubing-casing annulus. Once a specified amount of chemical is pumped, the well fluids are diverted from the flow line to the tubing-casing annulus by an arrangement of valves and piping. The well is pumped in this manner for several hours until the protective film is established on the sub-surface equipment. At this point, the well is placed back on production by diverting the well fluids back through the flow line.

Probably the most effective method of combating the corrosion is the continuous method because corrosion-inhibitor film is maintained on the equipment by continuous inhibitor injection. The problem with this method is that the chemical injection pumps available demand excessive maintenance and attention. In many instances, the pump will not inject the required amount or the pump will not inject at all. For these reasons, oil producers have become frustrated with the chemical pumps and therefore most oil producers treat their wells by the circulation method.

Corrosion experts believe that in severely corrosive atmospheric environments the sub-surface equipment also should be protected after removal from the well during well repair or servicing operations. Some oil producers pump high concentrations of oil and corrosion chemical down the tubing immediately before pulling the rods, or they coat the rods with oil and corrosion inhibitor while the rods are laying down. Other operators go one step further and attempt to coat the rods with corrosion chemical while the rods are being run in the well. This is accomplished by dumping a few gallons of chemical into the tubing and then running the rods into the well. The theory in this case is to run the rods through the chemical that has accumulated at the standing fluid level inside the tubing. However, it has been found that Pressure treating of sub-surface equipment with inhibitor greatly increases the effectiveness thereof.

Various forms of devices for applying chemical treating fluids to sub-surface well equipment heretofore have been provided. Examples of different forms of such previously known equipment as well as other similar structures are disclosed in U.S. Pat. Nos. 2,289,967, 3,378,088, 3,475,781, 3,901,313, 3,943,997, 3,958,049, 4,216,249 and 4,279,300.

However, most of these previously known forms of treating devices are either specifically designed for use in conjunction with down hole equip-ment being used to drill a well or are of a configuration which results in a treating apparatus having excessive overall height. In addition, some treating devices include an excess amount of removably engaged components including connections therebetween which are quickly loosened as a result of the jarring and jolting forces experienced by the above ground end of a well casing or tubing string during well servicing operations.

Accordingly, a need exists for an improved form of corrosion inhibiting chemical applying apparatus which may be mounted from the above ground end of a well casing or tubing string and utilized to pressure apply corrosion inhibiting chemicals to sub-surface equipment as that sub-surface equipment is run in the associated well. In addition, a corrosion inhibiting chemical applying apparatus including a minimum of removably joined components is needed in order to withstand the high jarring and jolting forces developed at the well head during well servicing operations.

BRIEF DESCRIPTION OF THE INVENTION

The main object of this invention is to provide a corrosion inhibiting chemical applying apparatus which may be mounted to the above surface end of a well casing or tubing string and utilized to pressure spray corrosion inhibiting chemical on the external surfaces of sub-surface equipment as that equipment is being run in an associated well.

Another object of this invention is to provide an apparatus in accordance with the preceding object and which is of minimum height and includes a minimum of removably joined components.

Still another object of this invention is to provide an apparatus which may be operated with a minimum of experience.

A final object of this invention is to provide a corrosion inhibiting chemical applying apparatus in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
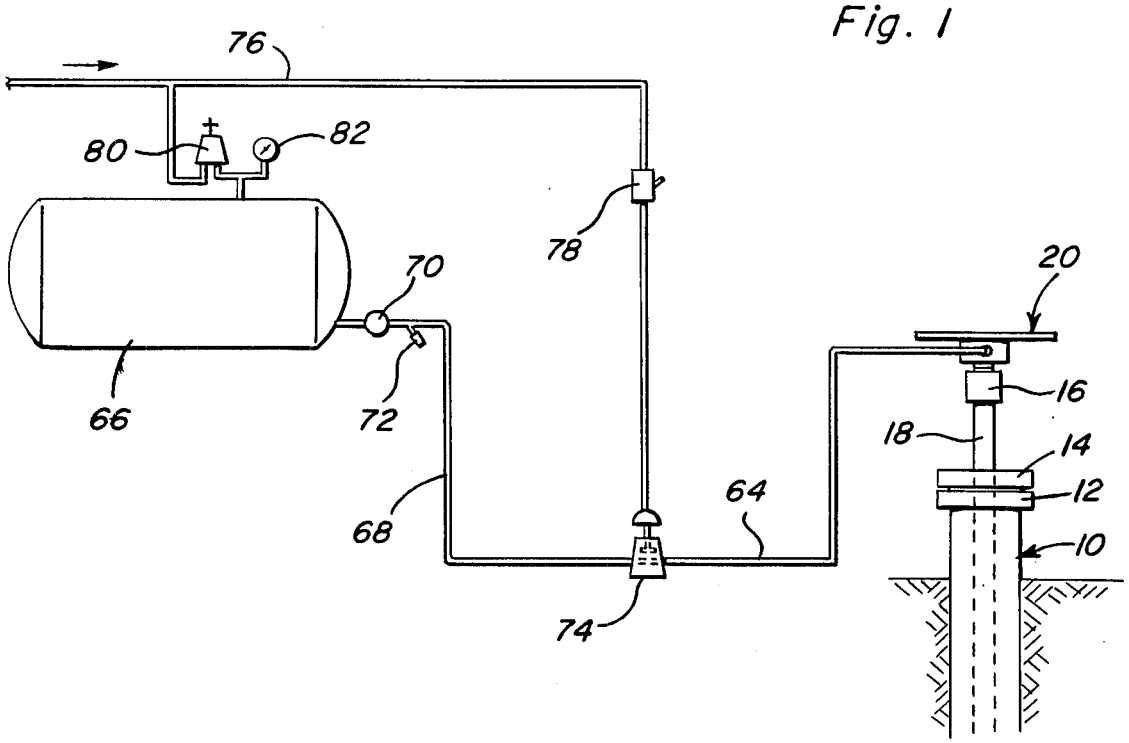
FIG. 1 is a schematic view illustrating the chemical applying apparatus mounted atop a pumping tee and with the pressurized inhibitor flow system in operative association with the apparatus.
Figure 2:
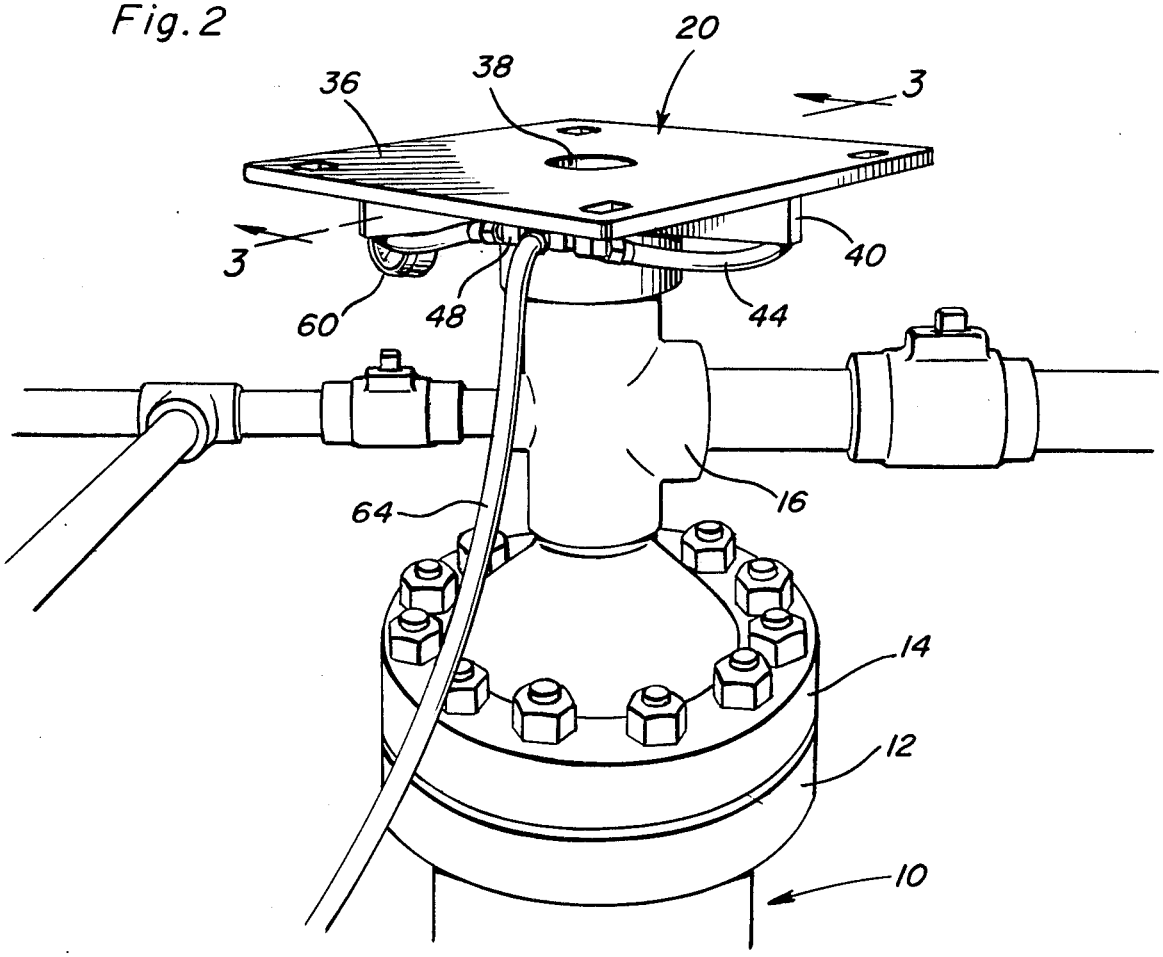
FIG. 2 is an enlarged perspective view of the chemical applying apparatus as mounted atop the pumping tee illustrated in FIG. 1.

Referring now more specifically to the drawings the numeral 10 generally designates a well casing including a bottom well head flange 12 and a top well head flange 14. A pumping tee 16 is mounted atop the tubing string 18 which projects downwardly into the casing 10 and a stuffing box is usually mounted atop the pumping tee 16 for receiving the polish rod (not shown) therethrough.

Figure 3:
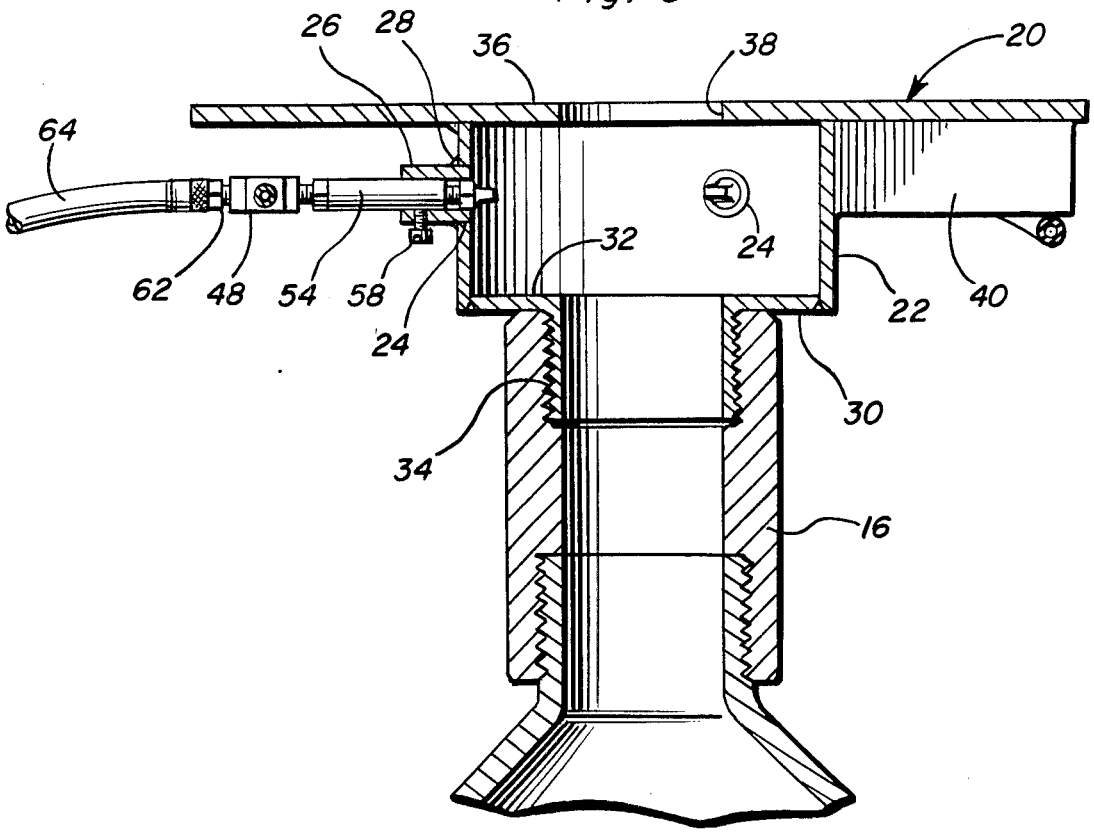
FIG. 3 is an enlarged fragmentary vertical sectional view taken substantially upon the plane indicated by the section line 3—3 of FIG. 2.
Figure 4:
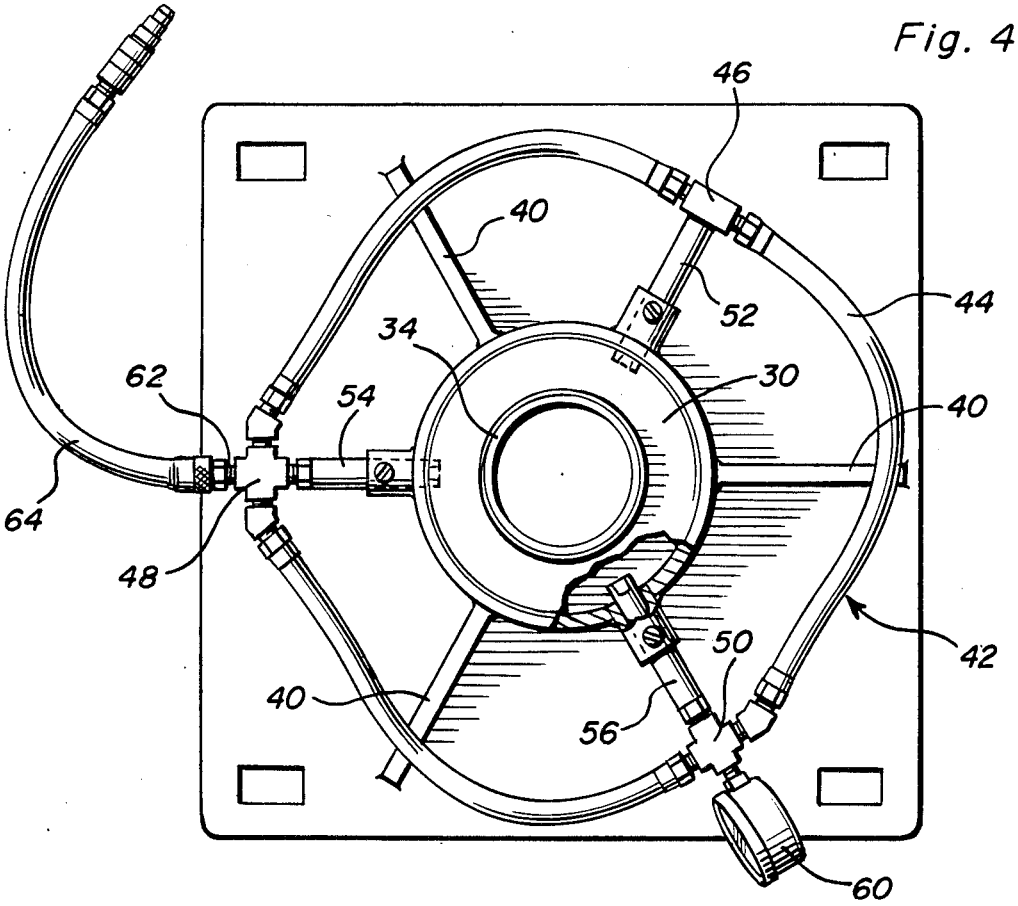
FIG. 4 is an enlarged bottom plan view of the chemical applying apparatus with forces thereof being broken away and illustrated in horizontal section.

However, the polish rod and stuffing box have been removed and the chemical applying apparatus of the instant invention is mounted atop the Pumping tee 16 and referred to in general by the reference numeral 20. The apparatus 20 comprises a tubular body 22 disposed in upright position and including three circumferentially spaced radial bores 24 formed therein in which the inner ends of generally radial support sleeves 26 are secured by welding 28, see FIG. 3. The tubular body 22 is disposed in upright position and includes a lower end wall 30 having a central opening 32 formed therein in which the upper end of an externally threaded depending tubular nipple 34 is sealingly secured. The upper end of the tubular body 22 is closed by a top mounting plate 36 secured thereover and including a central opening 38 formed therein which is of generally the same inside diameter as the tubular nipple 34. The mounting plate 36 projects considerably outwardly beyond the outer surfaces of the tubular body 22 and is braced relative to the latter by three circumferentially spaced gusset plates 40 secured to the outer surfaces of the tubular body 22 and the undersurface of the mounting plate 36.

A manifold assembly referred to in general by the reference numeral 42 is provided and includes three flexible tubing sections 44 arranged in end to end spaced relation and connected together through the utilization of fittings 46, 48 and 50 interposed therebetween and supporting tubular spray heads 52, 54 and 56 therefrom. The spray heads 52, 54 and 56 are secured in adjusted lengthwise shifted positions within the sleeves 26 by setscrews 58 carried by the sleeves 26 and the fitting 50 supports a pressure gauge 60 while the fitting 48 includes a fluid pressure inlet 62 to which the discharge end of a pressurized liquid supply line 64 is connected.

With attention now invited more specifically to FIG. 1 of the drawings, a corrosion inhibitor tank 66 is provided and includes a supply line 68 opening outwardly therefrom having a valve 70 and a strainer 72 connected therein. The discharge end of the supply line 68 is connected to the line 64 through a pneumatic control valve 74 and air under pressure is supplied to the interior of the tank 66 through an air supply line 76 extending to the control valve 74 and having a pneumatic switch 78 serially connected therein. The line 76 also opens into the interior of the tank 66 through a pressure regulator 80 having a pressure gauge 82 operatively associated therewith.

In operation, when it is desired to coat sucker rods with corrosion inhibitor, the pulling unit is driven to the oil well and rigged. The horse head is removed from the pumping unit and the polish rod and stuffing box are removed. The rods and pump are pulled out of the well if the pump is to be repaired. If the rods are parted a fishing tool is run in on the rods that have been previously removed and the parted rod is then caught by the fishing tool and brought to the surface. Once the parted rod is brought to the surface the apparatus 20 is attached to the pumping tee and each triple is sprayed with inhibitor by simply turning on the pneumatic switch 78 as each triple is run into the well. When a connection is being made the air switch 78 is placed in the off position so that inhibitor is not wasted during the connecting operation. Each triple is sprayed until the required amount of rods are run into the well. The apparatus 20 is then removed and the stuffing box is replaced on the pumping tee 16. Thereafter, the polish rod is screwed onto the last rod and the horse head is installed back on the pumping unit and attached to the polish rod.

If the tubing is to be coated, the pulling unit is rigged and the horse head is removed from the pumping unit. The polish rod and stuffing box are removed and the rods and pump are pulled out of the well. Thereafter, the circulating loop, the pumping tee and the top well head flange 14 is removed and the tubing is removed from the well. The apparatus 20 is then attached to the bottom well head flange 12 and the tubing, in doubles, are run into the well and each double is sprayed with inhibitor by turning the switch 78 on while each double is being run in the well. Once the required amount of tubing is in the well, the apparatus 20 is removed from the flange 12 and the top well head flange 14 is replaced. The circulating loop and pumping tee are again installed and the rods and pump are ready to be installed in the well. After the pumping tee is installed, the apparatus 20 may be attached to the pumping tee and each triple of rods may be sprayed as they are run in the well. Of course, the apparatus 20 may be specifically adapted for mounting on the pumping tee 16 or mounting on the casing flange 12.

It will be noted that the vertical height of the apparatus 20 is maintained at an minimum and, accordingly, the derrick man is still able to reach the elevator from a small work area in the derrick. Also, it will be noted that the tubular body 22 comprises an enlarged confined area between the smaller diameter tubular nipple 34 and the central opening 38 formed in the mounting plate 36. In this manner, the spray action of the spray heads 54 on the sub-surface equipment is accomplished in a maximum efficiency manner.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A corrosion inhibiting chemical applying apparatus for subsurface equipment including rods, tubing, pump and other equipment, either as such equipment is being pulled from a well or when such equipment is being run in the well, said apparatus including an upright tubular nipple for downward threaded mounting from the upper end of a well pumping tee, said nipple defining a vertical passage extending therethrough, an upstanding tubular body of greater inside diameter than the inside diameter of said nipple mounted and projecting upward from the upper end of said nipple, a horizontal top mounting plate secured over the upper end of said body and projecting condiserably outwardly beyond the outer surfaces of said tubular body and having a central opening formed therethrough substantially coaxial with said passage, a plurality of spray heads mounted externally upon and spaced about said tubular body and opening generally radially thereinto intermediate the opposite ends of said body and closely underlying said mounting plate, exterior manifold means communicated with each of said spray heads for supplying fluid under pressure from said manifold means to said spray heads, said manifold means including means for receiving therein anti-corrosive treatment liquids under pressure, said top mounting plate projecting horizontally outwardly of said spray heads and said manifold means, and an upstanding gusset plate secured between undersurface of said top mounting plate and the outer surface of said tubular body below said top mounting plate intermediate each pair of peripherally adjacent spray heads.

2. The apparatus of claim 1 wherein said manifold means comprises flexible tubing sections having adjacent ends releasably connected by tubular fittings, each of said spray heads being supported from a corresponding tubular fitting, said means for receiving anti-corrosive treatment liquid under pressure comprising an inlet opening into one of said fittings.

3. The apparatus of claim 1 including a plurality of tubular support sleeves opening into the interior of said tubular body from the exterior thereof and arranged generally radially of and angularly spaced about the center axis of said tubular body, said spray heads being telescoped into said support sleeves from the outer ends thereof and being releasably anchored in said support sleeves.

* * * * *